US008028749B2

(12) United States Patent
McHardy et al.

(10) Patent No.: US 8,028,749 B2
(45) Date of Patent: Oct. 4, 2011

(54) EXPANDING MULTIPLE TUBULAR PORTIONS

(75) Inventors: Colin McHardy, Aberdeen (GB); Simon John Harrall, Houston, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 12/790,585

(22) Filed: May 28, 2010

(65) Prior Publication Data

US 2010/0236792 A1 Sep. 23, 2010

Related U.S. Application Data

(62) Division of application No. 11/611,029, filed on Dec. 14, 2006, now Pat. No. 7,726,395.

(30) Foreign Application Priority Data

Dec. 14, 2005 (GB) ..... 0525410.7

(51) Int. Cl.
*E21B 43/10* (2006.01)

(52) U.S. Cl. ..... 166/207; 166/384; 166/216

(58) Field of Classification Search ..... 166/98, 166/99, 123, 181, 206–217, 384; 72/370.06
See application file for complete search history.

(56) References Cited

U.S. PATENT DOCUMENTS

| | | | | |
|---|---|---|---|---|
| 4,869,324 | A * | 9/1989 | Holder | 166/387 |
| 5,343,956 | A * | 9/1994 | Coronado | 166/387 |
| 6,021,850 | A | 2/2000 | Wood et al. | 166/380 |
| 6,860,329 | B1 | 3/2005 | Oosterling | 166/298 |
| 6,880,632 | B2 | 4/2005 | Tom et al. | 166/217 |
| 7,007,760 | B2 | 3/2006 | Lohbeck | 166/384 |
| 7,240,731 | B2 * | 7/2007 | Carmody et al. | 166/285 |
| 7,451,811 | B2 | 11/2008 | Lohbeck et al. | 166/207 |
| 7,500,389 | B2 | 3/2009 | Green et al. | |
| 7,640,976 | B2 * | 1/2010 | Filippov | 166/212 |
| 2003/0183395 | A1 | 10/2003 | Jones | 166/380 |
| 2004/0069496 | A1 | 4/2004 | Hosie et al. | |
| 2004/0099424 | A1 | 5/2004 | Smith | 166/382 |
| 2004/0123986 | A1 | 7/2004 | Hailey | |
| 2004/0149442 | A1 | 8/2004 | Mackenzie | 166/297 |
| 2004/0154797 | A1 | 8/2004 | Carmody et al. | 166/285 |
| 2004/0182569 | A1 | 9/2004 | Cook et al. | |
| 2004/0216892 | A1 | 11/2004 | Giroux et al. | |
| 2004/0216925 | A1 | 11/2004 | Metcalfe et al. | 175/57 |

(Continued)

FOREIGN PATENT DOCUMENTS

| | | |
|---|---|---|
| AU | 2003257881 | 11/2003 |

(Continued)

OTHER PUBLICATIONS

GB Search Report for Application No. GB110217.7 dated Mar. 14, 2011.

*Primary Examiner* — Kenneth L Thompson
(74) *Attorney, Agent, or Firm* — Patterson & Sheridan, L.L.P.

(57) ABSTRACT

Apparatus for expanding first and second portions of a downhole tubular in a single trip comprises a support and first and second expansion devices. The first expansion device is mounted on the support and is operable to expand a first portion of tubular. The second expansion device is mounted to a second portion of tubular and is adapted to be engaged by the support following the expansion of the first portion of tubular, and is then used to expand the second portion of tubular.

20 Claims, 13 Drawing Sheets

U.S. PATENT DOCUMENTS

| | | | | |
|---|---|---|---|---|
| 2004/0244968 | A1 | 12/2004 | Cook et al. | |
| 2004/0256115 | A1* | 12/2004 | Vincent et al. | 166/387 |
| 2005/0126251 | A1 | 6/2005 | Oosterling et al. | 72/393 |
| 2005/0161226 | A1 | 7/2005 | Duggan et al. | 166/380 |

FOREIGN PATENT DOCUMENTS

| | | |
|---|---|---|
| AU | 2003259669 | 11/2003 |
| GB | 2 393 986 | 4/2004 |
| GB | 2 402 689 | 12/2004 |
| GB | 2 402 952 | 12/2004 |
| GB | 2 405 884 | 3/2005 |
| GB | 2 403 749 | 12/2005 |
| GB | 2 418 217 | 3/2006 |
| WO | WO93/25800 | 12/1993 |
| WO | WO97/17524 | 5/1997 |
| WO | WO01/33037 | 5/2001 |
| WO | WO03/006788 | 1/2003 |
| WO | WO03/048503 | 6/2003 |
| WO | WO03/060289 | 7/2003 |
| WO | WO2004/007892 | 1/2004 |
| WO | WO2005/005772 | 1/2005 |

* cited by examiner

EXPANDING MULTIPLE TUBULAR PORTIONS

CROSS-REFERENCE TO RELATED APPLICATIONS

This application is a divisional of U.S. patent application Ser. No. 11/611,029 filed Dec. 14, 2006, now U.S. Pat. No. 7,726,395, which claims benefit of Great Britain Patent application number 0525410.7, filed Dec. 14, 2005. Each of the aforementioned related patent applications is herein incorporated by reference.

BACKGROUND OF THE INVENTION

1. Field of the Invention

This invention relates to expanding multiple tubular portions, particularly the expansion of multiple portions of a downhole tubular.

2. Description of the Related Art

In the oil and gas exploration and production industry expandable tubulars are being used in a number of applications. In some of these applications a continuous length of tubular is expanded to a larger diameter. In other applications it may be desired to expand different portions of a tubular to different diameters. One example of this is described in WO03006788 (Shell Internationale Research Maatschappij B.V.). This document describes an arrangement in which an expander comprising first and second expansion cones may be mounted on a support, the first cone having a larger outer diameter than the second cone. The cones are releasably interconnected. The expander is moved through a first tubular section to expand the tubular to the first diameter, and the first cone is then released from the expander. The second cone is then moved through a second tubular section to expand the section to the second diameter.

Applicant's WO04/007892 also describes expanding different sections of a tubular to different diameters.

SUMMARY OF THE INVENTION

According to the present invention there is provided a method of expanding first and second portions of a downhole tubular in a single trip, the method comprising:

translating a first expansion device mounted on a support through a first portion of tubular to expand said first portion of tubular; and then engaging a second expansion device with the support and translating the second expansion device through a second portion of tubular to expand said second portion of tubular.

According to another aspect the present invention there is provided apparatus for expanding first and second portions of a downhole tubular in a single trip, the apparatus comprising:

a support;

a first expansion device adapted to be mounted on the support and operable to expand a first portion of tubular; and a second expansion device adapted to be selectively engaged by the support following the expansion of the first portion of tubular and operable to expand a second portion of tubular.

The expansion devices may be translated in the same or in different directions.

The first and second portions of the tubular may comprise a common portion of tubular. Alternatively, the first and second portions may be separate or distinct portions of the tubular and may be adjacent or spaced apart. The first and second portions may be coupled, for example, by a third portion of tubular, which may be expandable or non-expandable, or may be unconnected. Ends of the first and second portions may form connectors, for connecting the tubular portions, or for connecting the tubular portions to further tubular portions. The connectors may be expandable or non-expandable. Thus the portions of tubular may be part of a common tubing string or may form parts of separate strings.

Each portion of tubular may take any appropriate form, and may comprise, for example, expandable slotted tubing, expandable sand screen, expandable solid-walled tubing, c-shaped tubing or corrugated tubing. The sections of tubing may be of common form, or may differ in one or more aspects. Each portion of tubular may be of constant or consistent form over its entire length, or may comprise more than one form of tubular.

The expansion diameters of the expansion devices may be the same, such that the tubular portions are expanded to the same or similar diameter, or may differ, for example the first expansion device may expand the first tubular portion to a greater diameter than the second expansion device expands the second tubular portion, or vice versa.

The expansion devices may take any appropriate form, and each device may operate using the same or a different expansion mechanism. The expansion devices may comprise fixed diameter expansion devices, such as fixed diameter expansion cones. The cones may be configured such that the cones expand the tubular portions to an internal diameter larger than the largest external diameter of the cones. In other embodiments variable diameter expansion devices or compliant expansion devices may be utilised. Expansion devices of different form may be provided for operation in the same trip, for example a fixed diameter expansion device may be provided in combination with a variable diameter device. Some devices may be adapted to be energised, manipulated or activated downhole to define a larger expansion diameter, and some devices may be collapsible, following use, to assume a smaller diameter.

The first portion of tubular may be located closer to surface than the second portion of tubular, or vice versa.

In one embodiment the tubular portions form part of a tubing string comprising a plurality of tubing forms. One particular embodiment comprises first and second tubular portions each comprising expandable sand screen coupled by a third tubular portion which is not expanded. The third tubular portion may carry a packer or other sealing arrangement on its outer surface, which packer may comprise a swelling material, for example a swelling elastomer. In another embodiment the first and second tubular portions may comprise seals or anchors coupled by a solid-walled third tubular portion, to form a straddle.

The third tubular portion may have an inner diameter less than an outer diameter of at least one of the first and second expansion devices. This offers particular advantages where it is desired to provide a section of smaller diameter tubular between sections of tubular which it is desired to expand to a larger diameter, for example a section of tubular incorporating a packer between sections of expandable sand screen it is desired to expand into contact with the surrounding formation. The ability to use a relatively small diameter third tubular portion provides for more scope in the form and function of the packer, for example, if a swelling elastomer packer is utilised, the diameter of the third tubular portion may be relatively small to allow an appropriate thickness of swelling elastomer to be provided.

A transition or crossover tubular may be provided above or below the first or second tubular portions for coupling tubular portions of different diameter or different form. A crossover tubular may comprise a portion of larger diameter and a portion of smaller diameter, or two portions of different form. Typically, the portion of smaller diameter is adapted to be coupled to an expandable first or second tubular portion. When provided above a tubular portion to be expanded in a top-down expansion, the crossover tubular may provide an area to initiate expansion, in that the expansion device may be moved through the larger diameter portion relatively easily, before encountering the smaller diameter portion, where progress of the expansion device is likely to encounter greater resistance as the smaller diameter portion is expanded. When provided below a tubular portion to be expanded, such a crossover may provide an area which allows an operator to detect the end of the expansion, as the resistance to progress of the expansion device may decrease when the expansion device moves into the larger diameter portion of the crossover.

At least one expansion device stop may be provided, to limit the translation of an expansion device. On the expansion device encountering the stop the operator may detect an increase to the resistance to movement of the expansion device, sometimes referred to as an increase in "weight on bit". The stop may comprise a profile. The stop may comprise an arrangement, such as a snap ring, to prevent retraction of the expansion device from the stop, such that the stop acts as an expansion device catcher.

The method may comprise further expanding at least one of the first and second tubular portions. The further expansion may be achieved using a third expansion device. The third expansion device may be utilised following the expansion of both first and second tubular portions, or may be utilised following expansion of the first tubular portion by the first expansion device and then again following expansion of the second tubular portion by the second expansion device. Alternatively, the third expansion device may only be employed to further expand one of the first or second tubular portions. The third expansion device may take any appropriate form and may comprise at least one radially extendable expansion member. The third expansion device may be a rotary expansion device. In one embodiment the third expansion device comprises rotatable expansion members and is adapted to be axially translated through the tubular portions to expand the tubular portions substantially without rotation of the device about the axis of the tubular portions. The third expansion device may be mounted on or to the support and the further expansion may be achieved in the same trip as the previous expansion of the tubular portion, that is both the initial and secondary expansion operations are achieved in a single trip.

The third expansion device may comprise a compliant expansion device, that is a device which may accommodate changes in expansion diameter and has particular utility where it is desired that the expanded tubular contacts and follows the contours of the surrounding bore wall, as may be the case for expandable sand screens. The first and second expansion devices used in conjunction with such a compliant device may comprise fixed diameter expansion devices.

In alternative embodiments a fourth expansion device may be provided. In other embodiments one or both of the first and second expansion devices may have multiple configurations, and be re-configurable to further expand one or both of the tubular portions. In one embodiment one of the first and second expansion devices is re-configurable to further expand one or both of the first and second portions, for example the second expansion device may be utilised to further expand the first tubular portion. In still further embodiments at least one of the first and second expansion devices may be utilised for further expansion with re-configuring the device.

The support may be adapted to selectively engage and disengage one or both of the first and second expansion devices, to allow the support to pick-up and then release an expansion device as required.

The engagement of the support with one or both expansion devices may be unidirectional, that is when engaged with the support the expansion device may be movable by the support in one direction, typically the expansion direction, but not in another direction, typically the opposite direction. In one embodiment this permits the support to move an expansion device through a tubular portion to expand the portion, but permits the support to be withdrawn from the tubular portion without the expansion device.

The first expansion device may be engaged by the support downhole, for example the device may be pre-installed on or proximate the first portion of tubular, but in other embodiments may be carried into the bore on the support.

The first expansion device may be released from the support after expanding the first tubular portion, or may remain coupled to the support.

The second expansion device may be released from the support following expansion of the second tubular portion, but in other embodiments may remain coupled to the support following the expansion operation.

The second expansion device may be provided, pre-installed, in a tubular, and may be provided proximate or towards one end of the second tubular portion, for example the proximal end, that is the end closest to surface. In other embodiments the second expansion device may be provided proximate or towards the distal end of the second tubular portion. Similarly, the first expansion device may be provided in the tubular, and may be provided towards one end of the first tubular portion, for example the proximal end, or the distal end.

One or both of the first and second expansion devices may be initially mounted on the support, or may be initially mounted to a tubular, which may incorporate a tubular portion to be expanded. The support may be run into a bore together with a tubular, or may be run into a previously installed tubular.

One or both of the support and a respective expansion device may be activated or actuated to assume an engagement configuration. Typically, the support is adapted to be activated or actuated to assume an engagement configuration. The activation or actuation may be achieved by any appropriate input. In one embodiment the support comprises one or more engagement members, such as keys, which are releasable, actuatable or otherwise configurable to assume engagement or extended configurations.

The engagement members may be biased towards or normally assume a retracted configuration, or may be biased towards or normally assume an extended configuration. The engagement members may be initially retained in the retracted configuration and adapted to be released to permit movement to the extended configuration. Release of the engagement members may be by any appropriate input, including fluid pressure, mechanical force, or an electrical or optical signal.

The person of skill in the art will recognise that many of the preferred and alternative features described above have utility independently of the aspects of the invention specifically identified herein, and may form separate aspects of the invention.

According to another aspect of the present invention there is provided a support for an expansion device, the support comprising:

a support mandrel; and at least one engagement member on the support mandrel adapted for selectively engaging an expansion device.

In a further aspect an expansion device may include an engagement member for selectively engaging a support member.

In a still further aspect the support mandrel may include an arrangement adapted to selectively release an expansion device, which arrangement need not necessarily comprise an engagement member.

The engagement member may be adapted to selectively release an expansion device from the support. Alternatively, or in addition, the expansion member may be adapted to selectively engage and allow pick-up of an expansion device. The engagement member may be adapted to release a first expansion device from the support and then engage a second expansion device, which may subsequently be released from the support. The engagement member may be adapted to selectively release or pick-up a plurality of expansion members. The release or pick-up of the plurality of expansion members may occur simultaneously or independently. A plurality of engagement members may be provided and the members may be operable in concert or independently.

The engagement member may be normally configured in an engagement configuration, which may be an extended position. The engagement member may be adapted to be reconfigured to a disengagement or retracted configuration. The engagement member may be reconfigured by application of fluid pressure. In other embodiments the engagement member may be normally configured in a retracted configuration.

The engagement member may be supported in an engagement configuration. An engagement member support may be provided and may be biased towards a support position, for example by a spring. The engagement member support may be configured to de-support the engagement member, for example by application of fluid pressure.

The engagement member may comprise a key located in a window. The window may be provided in a key support sleeve. The key support sleeve may be axially movable relative to the support mandrel.

The engagement member may be re-configurable by application of a reconfiguring force in a direction opposite to the direction of force applied to translate an expansion device to expand a tubular. The reconfiguring force may cause a releasable coupling, such as a shear pin, to fail or reconfigure. The reconfiguring force may cause relative movement of parts of the support.

The support may comprise an expansion device stabiliser, which stabiliser may comprise one or more extendable members.

The support mandrel may be adapted to selectively pass through and beyond an expansion device.

The support may comprise a through bore, permitting circulation of fluid through the support and into the bore in which the support is located.

The support through bore may comprise a flow restriction, which may be a nozzle, to facilitate creation of a fluid pressure differential. Such a fluid pressure differential may be utilised to reconfigure the support from an initial inactive or retracted configuration to an active or engagement configuration, or may be utilised to reconfigure the engagement member. Thus, embodiments of the support may be operated by circulating fluid through a conventional support string using conventional pumps; it is not necessary to provide dedicated control lines extending from surface.

The engagement member may be adapted to provide unidirectional engagement with an expansion device. In one embodiment, the support may be adapted to operatively engage an expansion device simply by axially translating the support relative to the expansion device, and to disengage the expansion device simply by axially translating the support in the opposite direction.

The support may be adapted for use in a top-down expansion operation, or alternatively in a bottom-up expansion operation.

The support may comprise an expander or expansion device. In one embodiment the support comprises an expansion cone. The expander may be an integral part of the support, or may be latched by the support or releasable from the support.

According to another aspect of the present invention there is provided a method of expanding portions of a downhole tubular, the method comprising:

expanding a first portion of tubular using an expansion device describing a first diameter; and expanding a second portion of tubular using an expansion device describing a second diameter, the expanded first and second portions of tubular being separated by a third portion of tubular having an internal third diameter smaller than said first and second diameters.

The first and second diameters may be the same, or may be different.

According to a still further aspect of the present invention there is provided a method of expanding first and second portions of a downhole tubular in a single trip, the method comprising:

translating a first expansion device in a first direction through a first portion of tubular to expand said first portion of tubular to a first diameter; and then translating a second expansion device in said first direction through a second portion of tubular to expand said second portion of tubular to said first diameter.

According to a yet further aspect of the present invention there is provided a method of expanding and logging a portion of a downhole tubular in a single trip, the method comprising:

translating an expansion device in a first direction through a portion of a downhole tubular to expand said portion of tubular; and then translating a logging device initially mounted proximate said portion of tubular in a second direction through said expanded portion of tubular.

BRIEF DESCRIPTION OF THE DRAWINGS

These and other aspects of the invention will now be described, by way of example, with reference to the accompanying drawings, in which.

DETAILED DESCRIPTION

Figure 1:
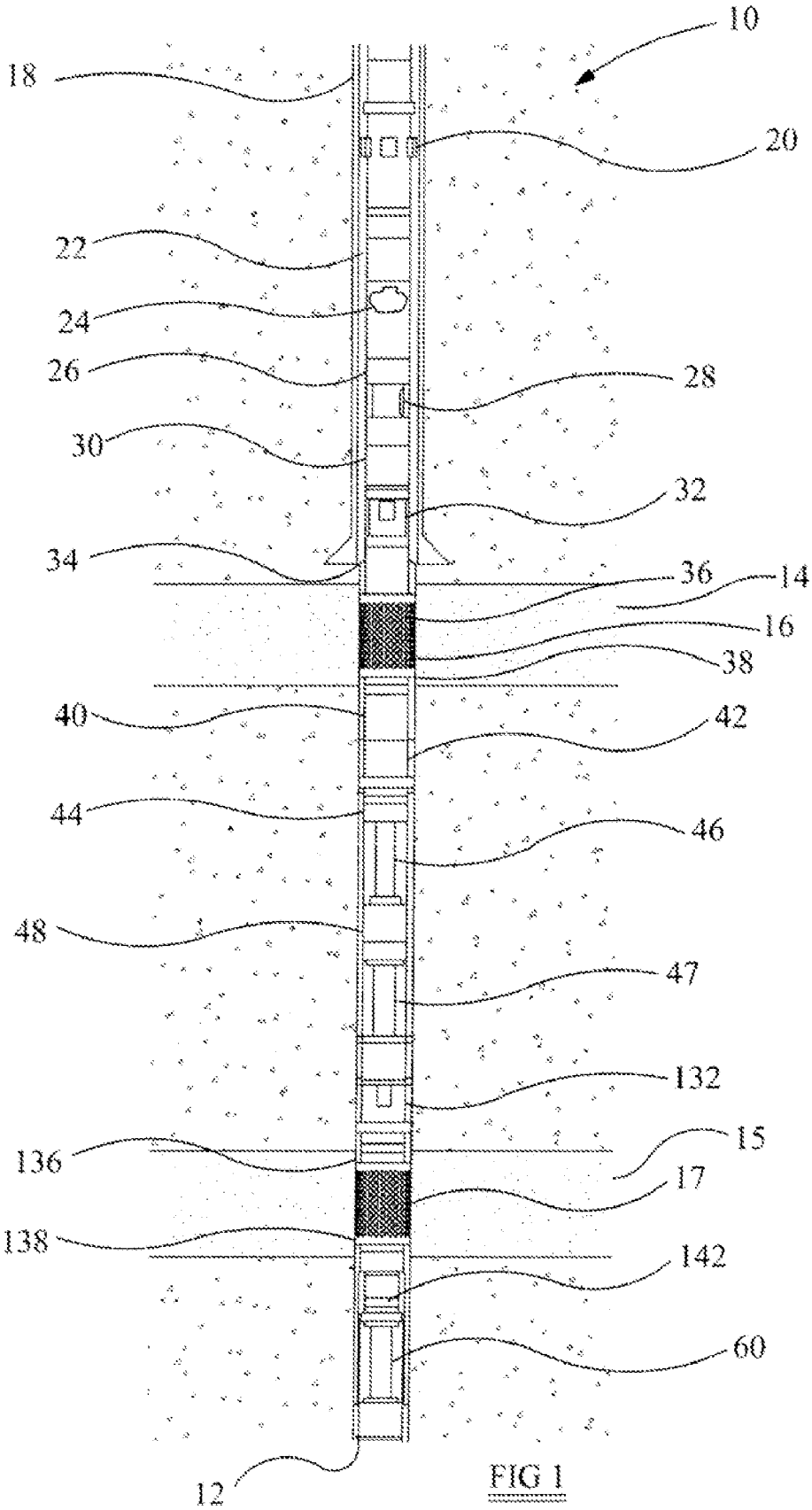
FIG. 1 is a schematic illustration of a completion string positioned in a well bore.
Figure 3:
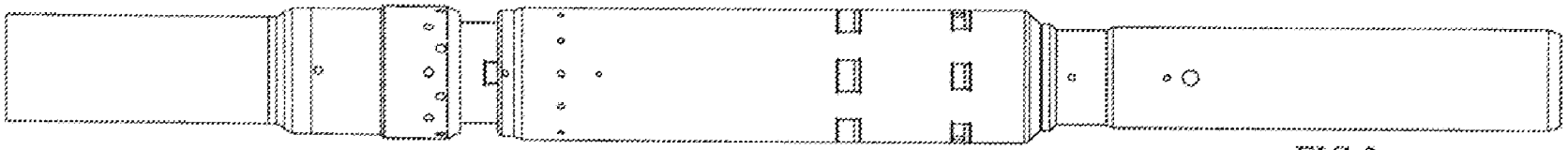
FIG. 3 is a view of the support mandrel of FIG. 2.

Reference is first made to FIG. 1 of the drawings, which is a schematic illustration of a completion string 10 positioned in a well bore 12, the completion string incorporating elements of embodiments of aspects of the present invention. Those of skill in the art will recognise that many of the elements of the string 10 are not essential or necessary to the operation of the present invention in its broadest aspects, nor are the specific dimensions mentioned below.

The string 10 is illustrated located in a drilled bore 12 which intersects two hydrocarbon-producing formations 14, 15. The string 10 is positioned in the bore 12 such that expandable sand screen assemblies 16, 17 forming part of the string 10 intersect each formation 14, 15. As will be described, the sand screen assemblies 16, 17 are expanded within the bore 12 into contact with the bore wall and allow oil or gas to flow from the formations 14, 15 into the string 10, and then to surface.

FIG. 1 also shows the lower end of a cemented casing 18, from which the string 10 is suspended by a 9⅝" by 7" hanger 20. Below the hanger 20 is a 7" handling pup joint, a length of blank pipe, and a further handling pup 22. The next component of the string is an optional flapper valve 24 which may be closed to protect the formations 14, 15 and also to provide a hydraulic barrier for packer setting and for testing the upper completion. Below the valve 24, a 7" section of blank pipe 26 connects the valve 24 to a shoulder sub 28, which will be described in greater detail below, with reference to FIG. 7 of the drawings. Further 7" handling pups 30 connect the shoulder sub 28 to a cone launcher 32, which will be described in more detail below with reference to FIG. 8 of the drawings. A 7⅝" spacer pup 34 connects the cone launcher 32, in this example, to an expandable top connector 36, which will be described in greater detail with reference to FIG. 9 of the drawings. The expandable sand screen assembly 16 is coupled to the top connector 36, and, in this example, also to an expandable bottom connector 38, which will be described in greater detail below with reference to FIG. 10 of the drawings. The bottom connector 38 is connected by way of a 7⅝" spacer pup 40, to a cone catcher 42, which will be described below in greater detail with reference to FIG. 11 of the drawings.

A further 7" handling pup 44 joins the cone catcher 42, in this example, to two 30 foot 7" swell packers 46, 47 spaced apart by a 7" handling pup, blank pipe and handling pup assembly 48. The lower swell packer 47 is joined by a 7" handling pup to the second expandable sand screen assembly 17, the assembly 17 including a further cone launcher 132, expandable top and bottom connectors 136, 138 and cone catcher 142. Below the assembly there is provided a further 30 foot 7" swell packer 60.

The completion 10 is initially mounted on a running string, the end of which is provided with a cone support mandrel 62, as illustrated in FIGS. 2, 3, 4, 5 and 6 of the drawings. As will be described, once the completion 10 has been run into the bore 12 and the hanger 20 engaged, the mandrel 62 is utilised to pick up or latch into an expansion cone 33 (FIG. 8) from the cone launcher 32, and then carry the cone 33 through the first expandable sand screen assembly 16 to expand the sand screen. The cone 33 is then caught by the cone catcher 42, and the mandrel 62 reconfigured to release the cone 33, to allow the mandrel 62 to advance through the packers 46, 47 and then pick up the second cone from the cone launcher provided in combination with the second sand screen assembly 17, and then carry the cone through the second assembly 17 to expand the sand screen, before the cone is caught by the second cone catcher. The mandrel 62 is then withdrawn, the first part of the expansion process having been completed.

In a preferred embodiment of the present invention, the expandable sand screen sections 16, 17 are then subject to further expansion using an expansion tool such as the applicant's axially compliant expansion tool, as supplied under the ACE trade mark, as described in WO03\048503, the disclosure of which is incorporated herein by reference.

During and following the setting and expansion operations, the swell packers 46, 47, 60 will be exposed to well fluid, and the packers 46, 47, 60 are such that the coating of elastomer on the packers will swell on such exposure and thus isolate the production zones, such that all the flow from the formations 14, 15 will be into the string 10.

The elements and operation of the completion 10 and the mandrel 62 will now be described in greater detail.

Reference is first made to FIGS. 2, 3, 4, 5 and 6 of the drawings, which illustrate the mandrel 62. The mandrel 62 has a generally cylindrical body 64 which provides mounting for selectively extendable and retractable keys 66, 67, the larger upper set of keys providing selective engagement for the expansion cones 33 to allow the cones 33 to be pushed through the completion 10, while the smaller lower set of keys 67 serve to centralise the cones 33 on the mandrel 62.

Figure 4:
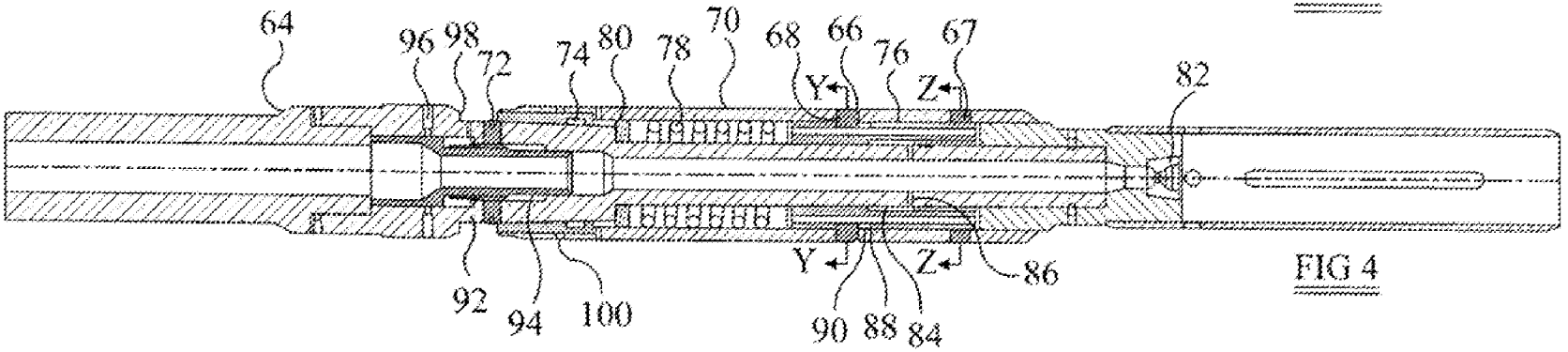
FIG. 4 is a sectional view on line A-A of FIG. 3.
Figure 6:
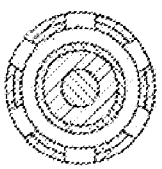
FIGS. 5 and 6 are sectional views on line Y-Y and Z-Z of FIG. 4, respectively.
Figure 5:
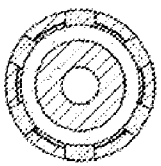
Figure 2:
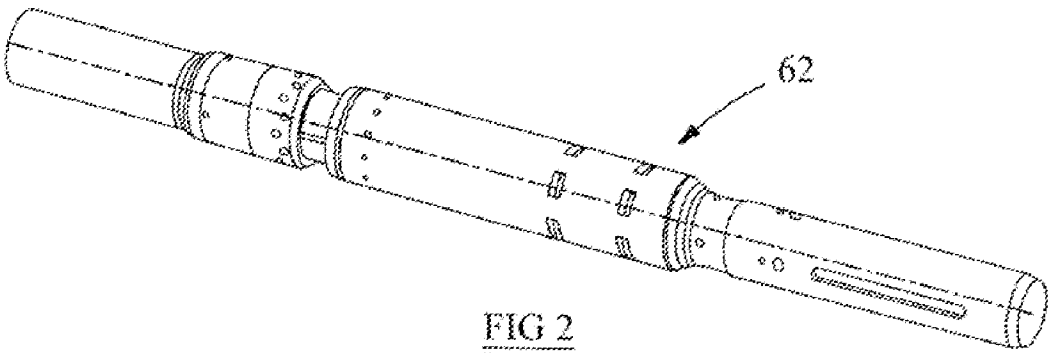
FIG. 2 is an isometric view of a support mandrel for use in expansion of elements of the string of FIG. 1.

The keys 66, 67 extend through windows 68 in a cylindrical key housing 70. The housing 70 is initially restrained in a position relative to the body 64 as shown in FIG. 4 by restraining keys 72 which abut the upper end of a ratchet ring 74 pinned to the key housing 70. This ensures that the keys 66, 67 initially remain in the retracted configuration, as illustrated in FIG. 4, allowing the mandrel to safely pass through the valve 24.

The keys 66, 67 are positioned over a support sleeve 76 which, following reconfiguration of the mandrel 62, may be moved to extend and retract the keys 66, 67. A spring 78 is provided between a shoulder 80 on the body 64 and an upper end of the support sleeve 76, and normally urges the sleeve 76 axially downwards. Movement of the sleeve 76 in the opposite direction, that is upwards, is achieved by application of internal fluid pressure. Such fluid pressure is created within the mandrel body 64 by provision of a nozzle 82 within the lower part of the mandrel 62. The pressure within the mandrel body 64 is communicated to a pressure chamber 84 formed between the sleeve 74 and the body 64 via pressure ports 86. As will be described, once the mandrel 62 has been activated, the keys 66, 67 are normally extended, and application of fluid pressure is required to move the support sleeve 76 to de-support the keys 66, 67.

In the initial, dormant configuration, upward movement of the key support sleeve 76 relative to the body 64 and the key housing 70 is prevented by the engagement of a shoulder 88 on the support sleeve 76 with an opposing shoulder 90 on the housing 70.

The keys 72 which initially prevent upward movement of the key housing 70 relative to the mandrel body 64 are supported on a sleeve 92 mounted on a differential piston 94 within the body 64. The piston 94 is initially fixed relative to the body 64 by a shear pin 96. However, if the differential pressure between the interior of the mandrel body 64 and the exterior of the body 64 is sufficient, the pin 96 will shear, allowing the piston 94 to move axially downwards in the body 64, to de-support the keys 72. This allows the key housing 70 to move axially upwards on the body 64 under the influence of the pressure force acting on the support sleeve 76, which force is transferred to the key housing 70 via the shoulders 88, 90. The support sleeve 76 and the key housing 70 move upwards, against the action of the spring 78, until the upper end of the ratchet ring 74 engages a body shoulder 98. When the pumps are shut off and the pressure within the tool body 64 falls, the ratchet ring 74 retains the key housing 70 in its raised position, however the spring 78 will push the support sleeve 76 axially downwardly on the body 64, in which position the sleeve 76 will support the keys 66, 67 in their extended configurations.

If it is subsequently desired to retract the keys 66, 67, the pumps are started up and internal tool pressure increased sufficiently to move the support sleeve 76 upwardly, against the spring 78, to allow the key 66, 67 to fall into the recesses in the support sleeve 76.

To permanently retract the keys 66, 67, or for use in the event of difficulty, where it is, for example, not possible to otherwise move the support sleeve 76 to de-support the keys 66, 67, a shear pin 100 is provided between the key housing 70 and the ratchet ring 74. Thus, by pulling the mandrel 62 upwardly against a restriction which engages the keys 66, the pin 100 may be sheared to allow the key housing 70 and the keys 66, 67 to move downwards relative to the body 64, such that the keys 66, 67 are located over the recesses in the sleeve 76 and de-supported.

A ratchet thread or the like may be provided to ensure that the keys 66,67 remain in the retracted configuration, to ensure, for example, that subsequent movement of the mandrel 62 through bore restrictions does not result in the keys being extended.

Figure 7:
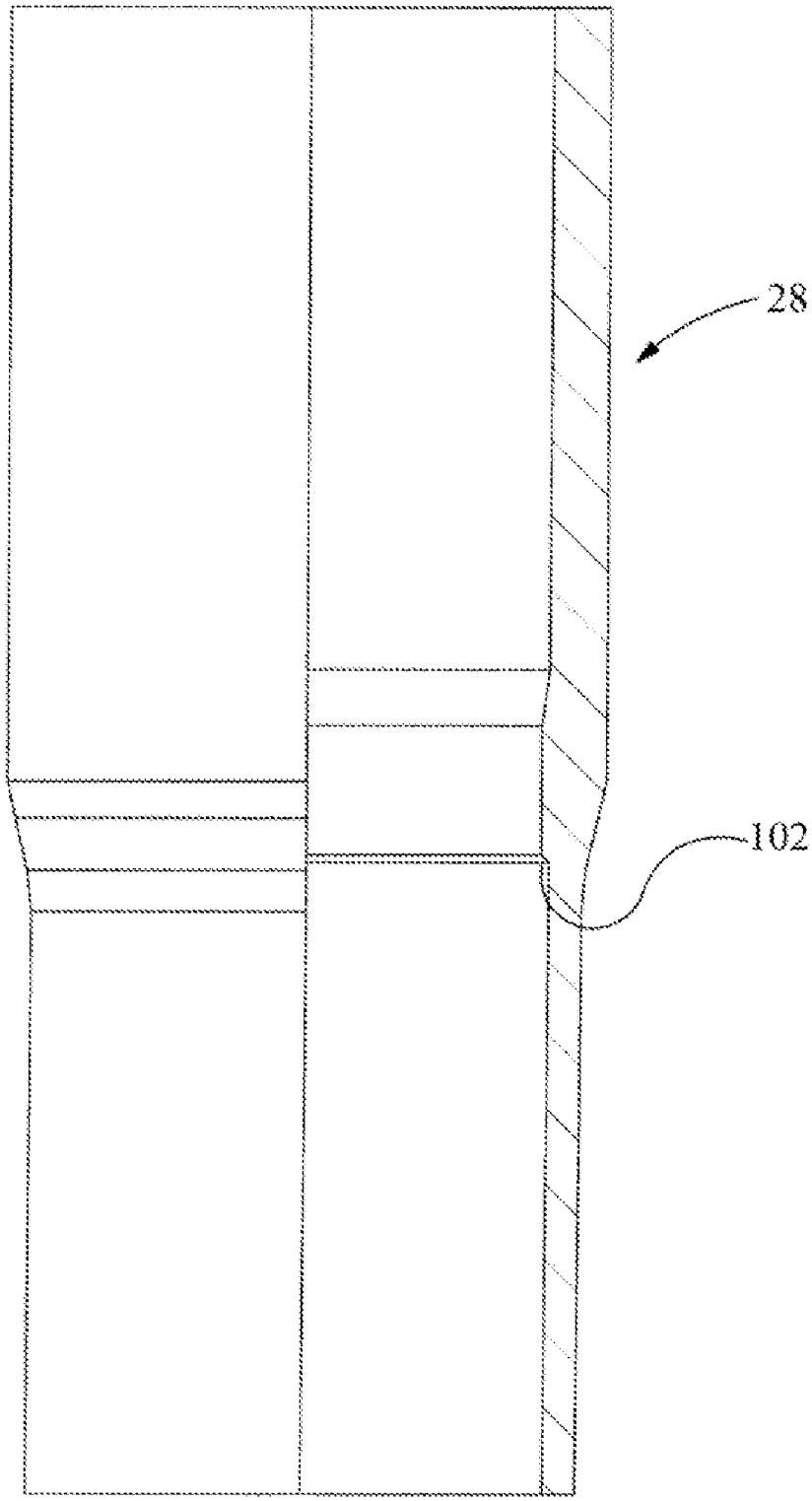
FIG. 7 is an enlarged part cut-away view of a shoulder sub crossover of the string of FIG. 1.

Reference is now made to FIG. 7 of the drawings, which illustrates the shoulder sub 28. One of the primary features of the sub 28 is the provision of a 45° shoulder 102, at which point the internal diameter of the sub 28 changes from 6.174" to 5.951". In the event of a difficulty which prevents the keys 66, 67 from being retracted through movement of the support sleeve 76, by lifting the mandrel with the keys 66, 67 extended, the upper keys 66 will engage the shoulder 102 and an over pull may then be applied to shear the pin 100 and allow retracting of the keys 66, 67.

Figure 8:
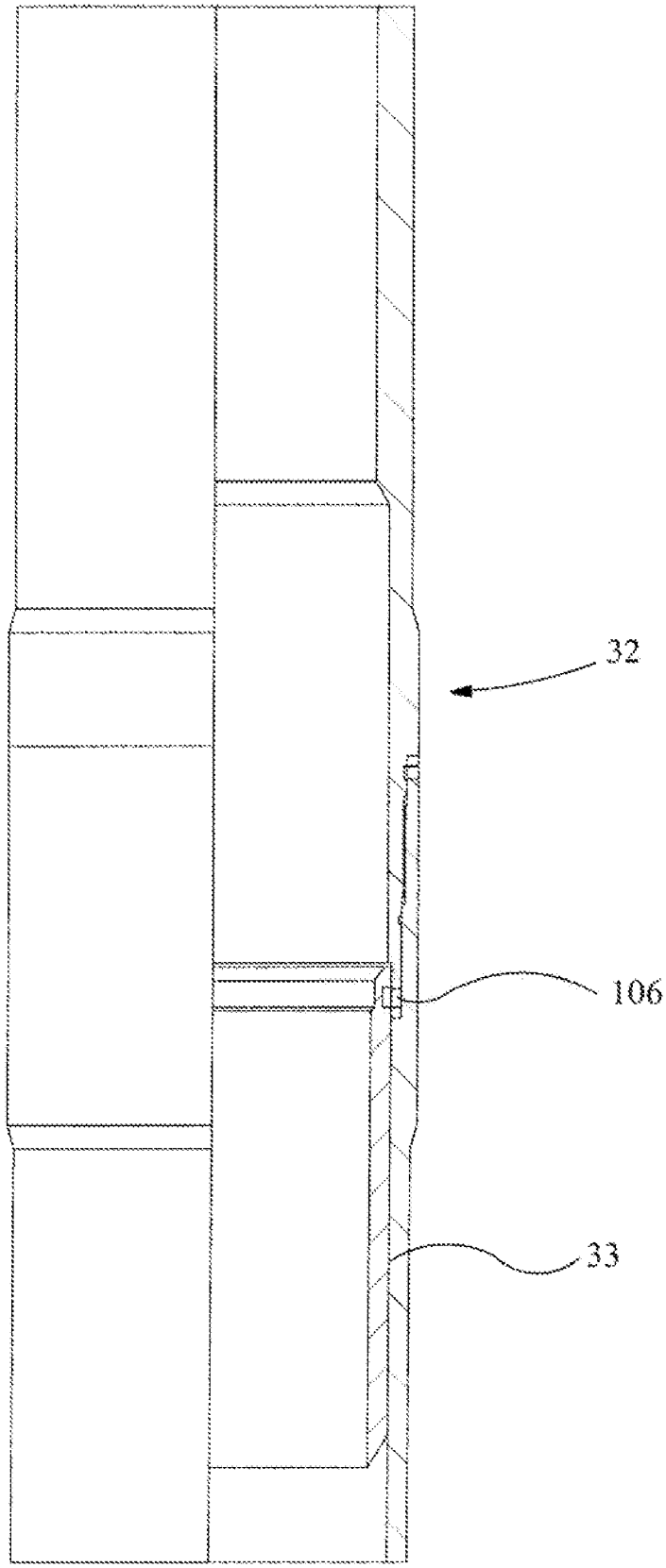
FIG. 8 is an enlarged part cut-away view of a pre-installed cone assembly of the string of FIG. 1.

Reference is now made to FIG. 8 of the drawings, which illustrates the cone launcher 32 and which, as noted above, accommodates a cone 33, in this embodiment the cone 33 having a maximum outside diameter of 6.75" and a minimum inside diameter of 5.994". The cone 33 is initially retained within the cone launcher 32 by eight shear screws 104. It will also be noted the upper end of the cone 60 defines a shoulder 106 adapted to engage with the extended keys 66 of the mandrel 62.

Figure 9:
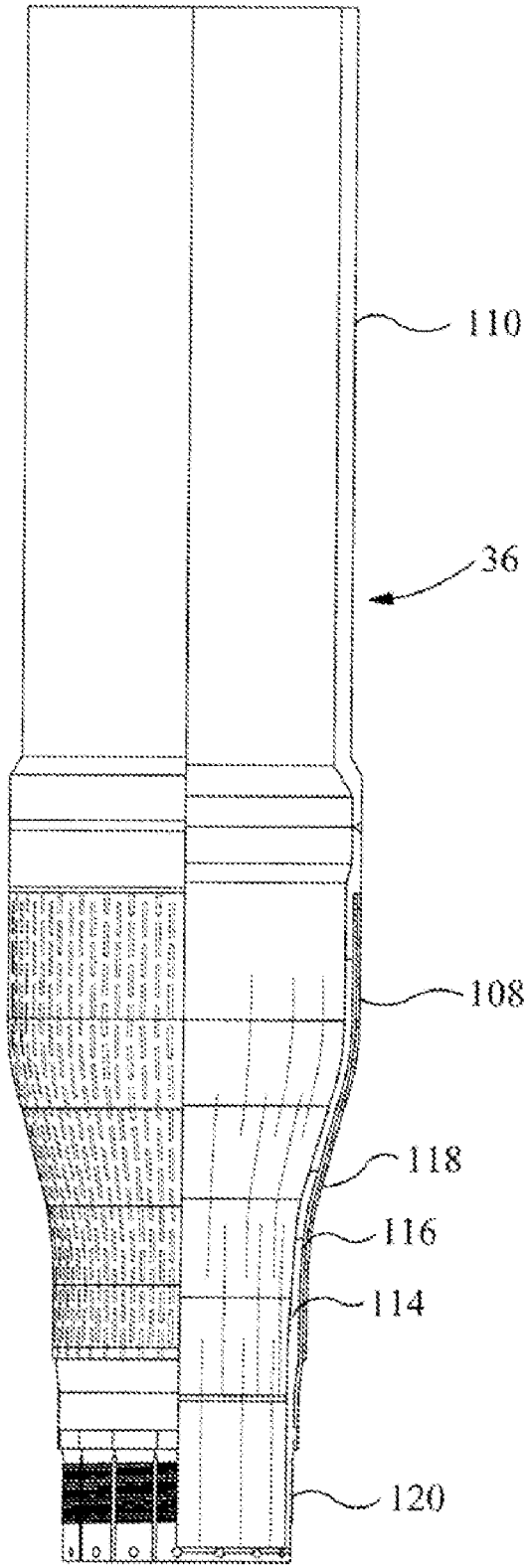
FIG. 9 is an enlarged part cut-away view of an expandable top connector of the string of FIG. 1.

Reference is now made to FIG. 9 of the drawings, which illustrates the expandable top connector 36. The connector 36 comprises a short pre-formed section of expandable sand screen 108 which serves as a crossover between the blank or solid space-out pipe 110 at the top of the expandable sand screen assembly 16 and the main section of expandable sand screen. The sand screen comprises a slotted base pipe 114 around which are fixed leaves of filter mesh 116, and around which is mounted a protective outer expandable slotted shroud 118, as described in WO97\17524 (Shell).

Figure 10:
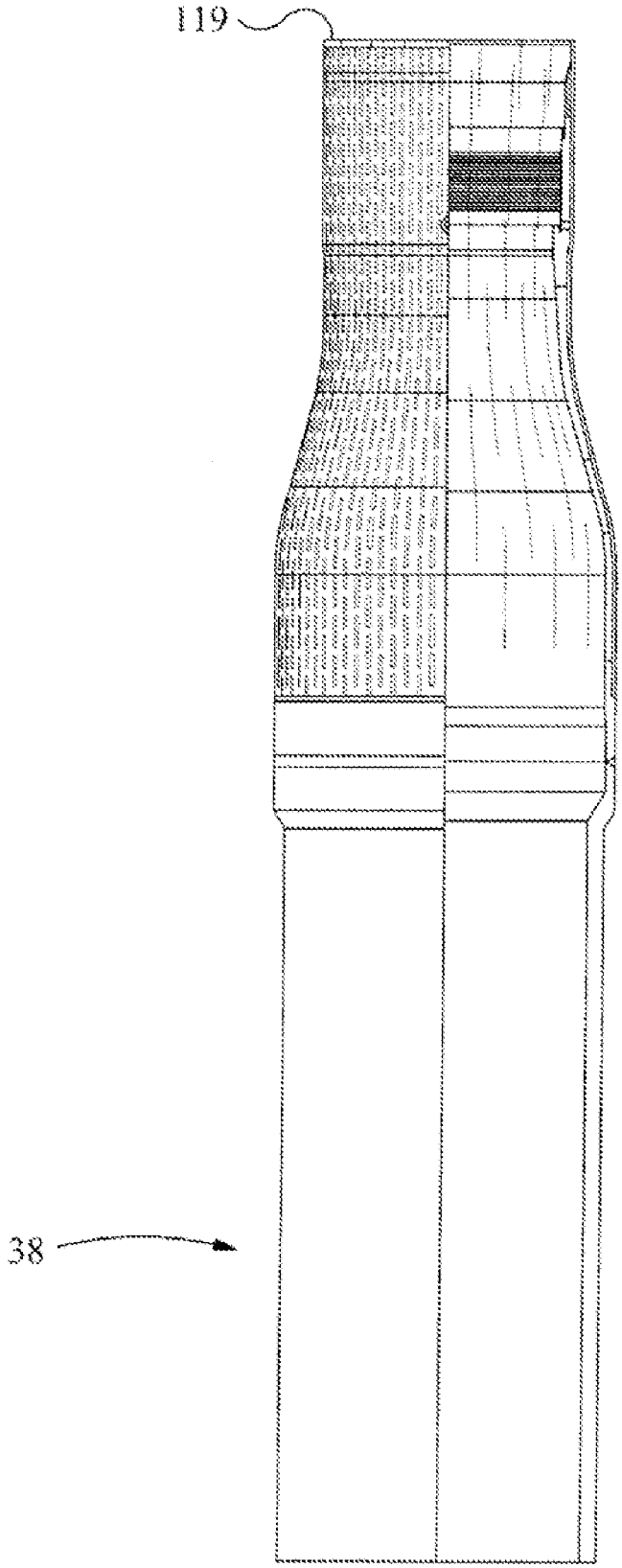
FIG. 10 is an enlarged part cut-away view of an expandable bottom connector of the string of FIG. 1.

The expandable bottom connector 38, as illustrated in FIG. 10, is of generally similar construction to the top connector 36, however the bottom connector 38 features a female or box connector 119 for coupling with the main expandable sand screen section, in contrast to the mole or pin connection 120 of the top connector 36.

Figure 11:
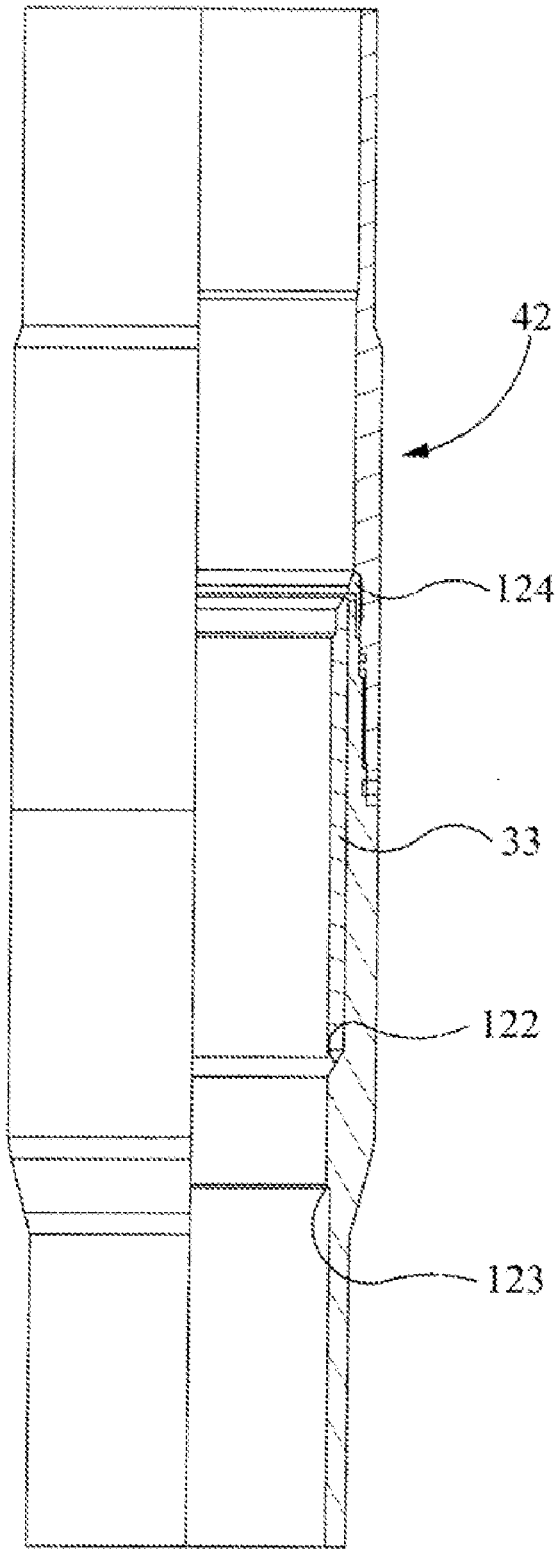
FIG. 11 is an enlarged part cut-away view of a cone catcher assembly of the string of FIG. 1.

Reference is now made to FIG. 11, which illustrates the cone catcher 42, the cone catcher 42 featuring an internal profile 122 configured to stop the progress of the cone 33 through the string. The Figure illustrates a cone 33 in the catcher 42. A further, oppositely directed profile 123 is provided below the profile 122. The cone catcher 42 also features a snap-ring 124 profiled to permit the cone 33 to pass through the ring 124, but which will prevent the cone 33 moving in the opposite direction, such that the cone 33 may be trapped between the profile 122 and the snap-ring 124.

The setting of the string 10 will now be described in more detail.

This embodiment of the invention is utilised where it is desired to produce from two spaced formations 14, 15, and the nature of the formations 14, 15 is such that it is desired to prevent or limit sand ingress, and therefore the completion 10 incorporates screens 16, 17. As is normally the case in such situations, it is desired to isolate the formations 14, 15 from the rest of the bore, and from one another, and the swell packers 46, 47, 60 are provided for this purpose. However, the internal diameter of the swell packers is such that the expansion cones 33 used to provide the first stage of the sand screen expansion operation are too large to pass through the swell packers 46, 47. As will be apparent from the description set out below, any difficulties associated with this arrangement are overcome by means of this preferred embodiment of the present invention.

The string 10 will be assembled on surface and run into the bore, mounted on the end of a suitable running string, the mandrel 62 being secured to the end of the running string. The completion string 10 is run into the bore and engages the hanger 20 in a conventional manner. Once the hanger 20 has set, the support string is released from the completion string 10 and the mandrel 62 may be run further into the hole. The mandrel 62 is run through the interior of the completion string 10, through the valve 24 and the shoulder sub 28, and then held above the first cone launcher 32.

The pumps on surface are then switched on to move the differential piston 94 and the key support 92 downwardly relative to the keys 72. Simultaneously, fluid pressure is urging the key support sleeve 76 and also the key housing 70 axially upwards. Thus, as the piston 94 is moved to de-support the keys 72, the key housing 70 is moved upwards into engagement with the body shoulder 98, which position is retained by the action of the ratchet ring 74. If the pumps are then shut down once more, the spring 78 moves the support sleeve 76 axially downwards, and extends the keys 66, 67.

The mandrel 62 is then run down into the cone launcher 32. The lower set of keys 67 will pass into the cone 33, while the upper keys 66, which describe a larger diameter, engage with the cone shoulder 106. The operator then picks up on the mandrel support string to neutral weight, prior to setting down weight, in this embodiment 24,000 lbs, to shear the screws 104 and shear out the cone 33 from the cone launcher 32.

On the cone 33 shearing out of the cone launcher 32 a weight loss will be noticeable at surface, as the cone 33 moves through the larger diameter upper portion 110 of the top connector 36. However, as the cone 33 encounters the transition section 108 of the connector 36, and begins to expand the sand screen, the weight increase will be seen at surface.

The cone 33 is then advanced through the sand screen, expanding the sand screen to a diameter slightly larger than the cone outer diameter, as described in WO93\25800 (Shell). The operator on surface will likely see a substantially constant weight as the cone 33 moves through the sand screen, however the weight will reduce to zero as the cone 33 moves into the larger diameter section of the bottom connector 38, which is of larger internal diameter than the cone outer diameter. The cone 33 is run through the connector 38 into the cone catcher 42, and on engaging the cone catcher profile 122 an increase in weight will be seen at surface.

The mandrel 62 is then picked up, the cone catcher snap-ring 124 retaining the cone 33 within the catcher 42. The fluid pumps on surface are then switched on, and the resulting increase in fluid pressure causes the support sleeve 76 to move axially upwards, and de-support the keys 66, 67. While maintaining this fluid pressure, the mandrel 62 is lowered through the cone catcher 42, and the cone 33 therein, until the mandrel 62 is located above the second cone launcher 132. The pumps are then shut down such that the spring 78 moves the support sleeve 76 downwards to extend the keys 66, 67. Further running in of the mandrel 62 will cause the second cone to be latched by the mandrel 62, allowing expansion of the second sand screen assembly 17, downward movement of the mandrel 62 and cone continuing until the second cone is retained by the second cone catcher 142.

The pumps are then switched on to increase internal tool pressure, and cause the support sleeve 76 to move to de-support the keys 66, 67. The mandrel 62, with the keys retracted, is then moved downwardly through the retained cone. After passing through the cone, the pumps are shut down once more, such that the keys 66, 67 extend. The mandrel 62 is then lifted to bring the keys 66 into contact with the cone catcher profile 123. An over pull is then applied to the mandrel 62, which causes the shear screws 104 to fail, and the key housing 70 to separate from the ratchet ring 74 and move axially downwards on the mandrel body 64, allowing the key 66, 67 to retract.

The upward movement of the running string through the completion 10 is then continued until the axial compliant expansion (ACE) tool is positioned above the uppermost expandable top connector 36. The expansion tool is fluid pressure activated, such that pumping down the string will activate the tool. However, it should be noted that the fluid pressure necessary to actuate the tool is significantly higher than the fluid pressure necessary to move the support sleeve 76 to de-support the keys 66, 67, such that the expansion tool would not have been activated during any of the previous procedures. The running string is then advanced through the completion 10 once more, with the axially compliant expansion tool moving through the expandable sand screen assembly 16, further expanding the sand screen into contact with the surrounding bore wall, as described in applicant's WO03\060289. Once the expander has moved through the expandable bottom connector 38, movement of the running string is stopped, and the pumps shut down. The expansion tool is then run into the next sand screen location, and the secondary expansion process repeated.

Once the sand screens have been expanded, as described above, the running string is picked up and may subsequently be used to function and pressure test the flapper valve.

Those of skill in the art will recognise that the above-described embodiment is merely exemplary of the present invention, and that various modifications and improvements may be made thereto without departing from the scope of the invention. For example, in the above example both sand screen assemblies 16, 17 are expanded by the cones before fully expanding the assemblies using the axially compliant expansion tool. In other embodiments the first sandscreen 16 may be fully expanded, that is expanded by both the cone 33 and the axially compliant expansion tool, before expansion of the second sandscreen 17 is initiated.

In other embodiments, sand screen assemblies, or indeed any other form of tubular, may be expanded solely by the expansion cones, with no further expansion by the axially compliant expansion tool being necessary.

Those of skill in the art will also have recognised that FIG. 1 illustrates a specific form of completion string, and that the invention has equal utility in expanding other arrangements and forms of tubulars. The support may be utilised in other expansion methods and apparatus and, for example, a support for an expansion device in accordance with an aspect of the invention may be utilised to facilitate an expansion method such as illustrated and described in WO 03006788, as is set out below.

Figure 12:
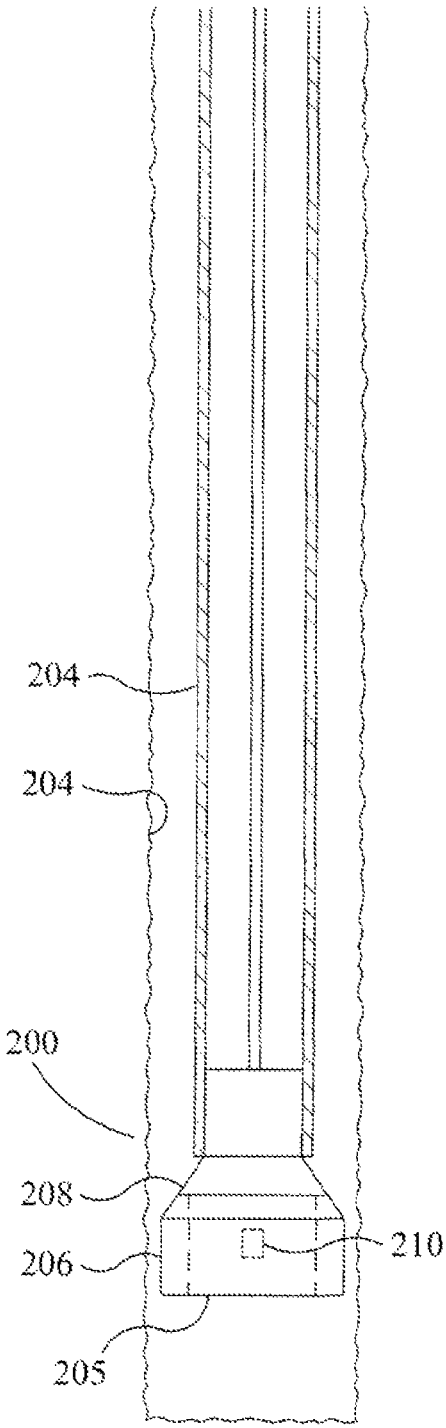
FIGS. 12, 13 and 14 are schematic illustrations of a tubular expansion operation in accordance with a further embodiment of the present invention.
Figure 13:
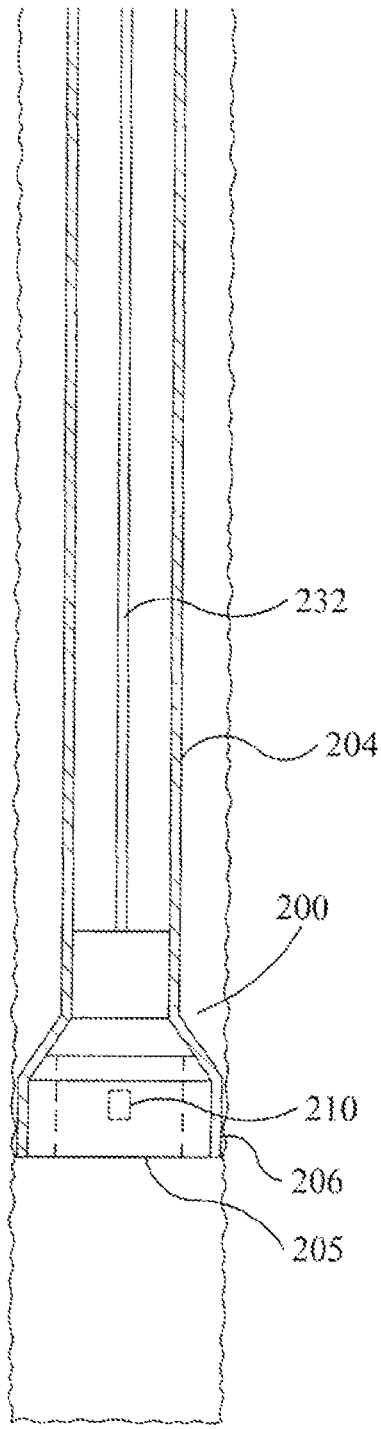
Figure 14:
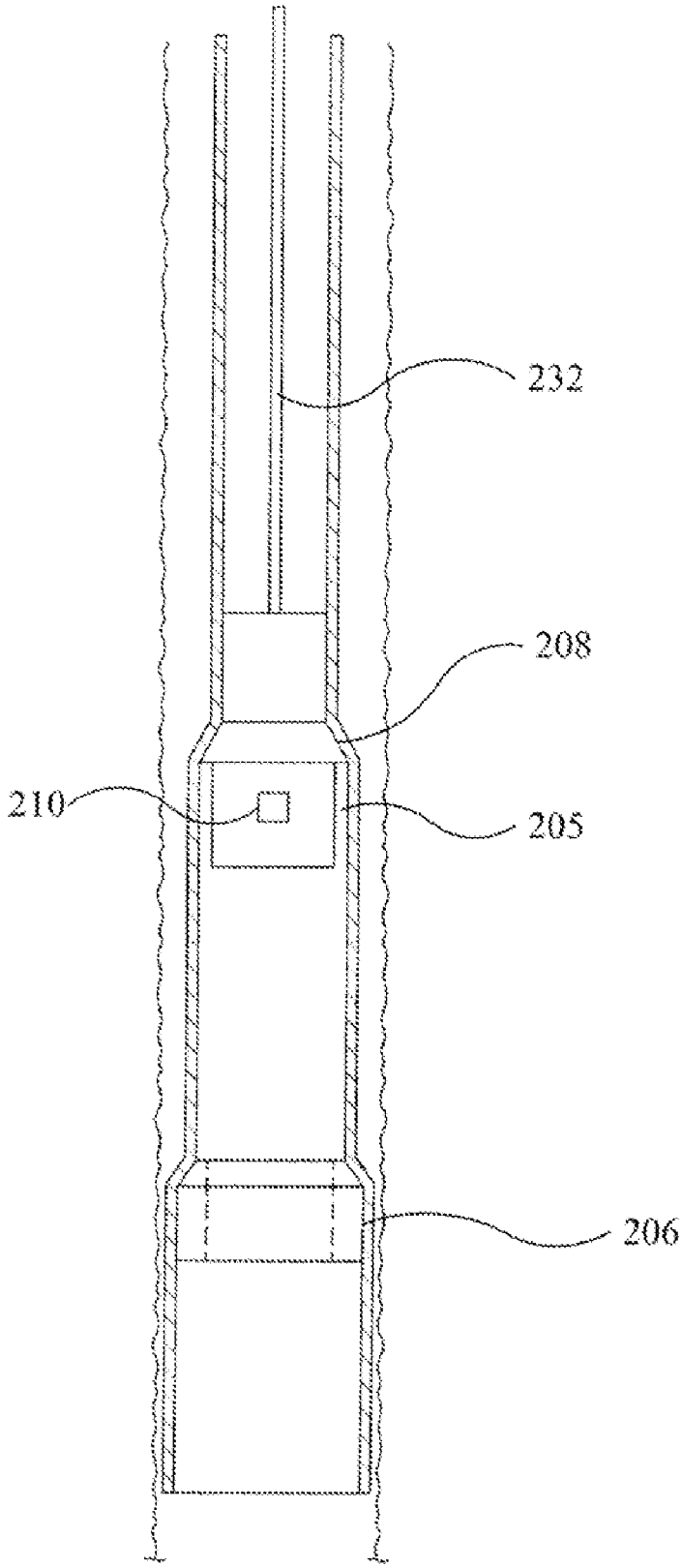

Reference is now made to FIGS. 12, 13 and 14 of the drawings, which illustrate an alternative tubular expansion operation in accordance with a further embodiment of the present invention. In this embodiment an expansion arrangement 200 is run into a bore 202 with a tubular 204, as shown in FIG. 12. The expansion arrangement 200 comprises a mandrel 205 providing mounting for a larger expansion cone 206 and a smaller expansion cone 208. The larger cone 206 is utilised to expand a lower end portion of the tubular 204 and is then released from the mandrel 205, and the remainder of the tubular expanded using the smaller cone 208.

The mandrel 205 features cone-latching keys 210 of generally similar form to the keys 66 provided on the mandrel 62 as described above with reference to the first illustrated embodiment and which retain the larger cone 206 on the mandrel 205. However, the axial orientation of the mandrel 205 is reversed, given that the arrangement 200 is utilised in a bottom-up expansion and must be capable of transmitting upwardly directed axial force from the mandrel 205 to the expansion cones 206, 208.

Once the tubular 204 is at the desired depth in the bore, initial upward movement of the arrangement 200 expands the lower end of the tubular, as illustrated in FIG. 13. The larger cone 206 is then released from the mandrel 205 by pumping fluid from surface through the support string 232 to release and allow retraction of the cone-latching keys 210. The larger cone 206 is then retained in the expanded end portion of the tubular 204, while the expansion of the tubular 204 continues with the smaller cone 208, as illustrated in FIG. 14.

In other embodiments, one or both of the cones may be pre-installed in the tubular and the mandrel run in separately to pick-up the cones and then translate the cones through the tubular. One or both of the cones may then be released from the mandrel, and the mandrel retrieved.

In a variation of this embodiment, the cone-latching keys may be releasable by application of a predetermined force, for example the keys may include shear pins or be sprung, such that if the larger cone 206 encounters a restriction preventing the expansion of the tubular and the further progress of the cone 206, the keys release the cone 206. Thus, the cone 206 is automatically released on experiencing a predetermined resistance force. Alternatively, the cone-latching keys may be operator-controlled, such that the operator may release the cone if the applied force necessary to advance the cone rises above a predetermined threshold value. The threshold value may be dependent on the resistance to movement experienced by the cone, or alternatively may be the maximum force it is possible to apply to the support on which the cone is mounted. The actual force experienced by the cone may be less than the force applied at surface, due to friction, hole deviation and the like. This allows the remainder of the tubular 204 to be expanded, albeit to a smaller diameter, using the smaller cone 208. In such applications, the differences in diameter between the two cones may be kept to a minimum, and three or more cones, or other expansion devices, may be provided. Of course the tubular 204 may take any appropriate form, and may be an expandable sand screen.

The restriction may take the form of a physical feature of the bore or the tubular which limits or restricts the expansion of the tubular, or may be as a result of a limitation in the force that may be applied to the cone, for example due to hole deviation, draw works limitations, friction or the like.

In a further embodiment, the operator may return to re-latch the larger cone 206 and then further expand the tubular portion previously expanded using the smaller cone 208, and this further expansion may be achieved with a lower force than that required to carry out a single-step expansion using the larger cone 206.

Reference is now made to FIGS. 15, 16, 17 and 18 of the drawings, which are schematic illustrations of a top-down straddle setting operation in accordance with another embodiment of the present invention. A straddle assembly 300 is to be set to isolate a casing section 302, although the same procedure could be utilised in an unlined or open hole. The straddle assembly 300 comprises upper and lower seals 304, 306, which may incorporate elements to assist in anchoring the assembly 300 to the casing 302, a central solid-walled tubing section 308 between the seals 304, 306, and upper and lower expansion cones 310, 312 initially located above the respective seals 304, 306.

The assembly 300 is run into the casing section 302 and held in position by one or both of the running tool and a temporary anchor. The top cone 310 may have been mounted to the expansion mandrel 314 (FIG. 16) during initial assembly or make up or the expansion mandrel 314 may pick up the pre-installed cone 310 at the commencement of the straddle setting operation. In any event, the cone 310 is run through the upper seal 304 on the mandrel 314 and sets the seal 304 and also anchors the assembly 300 in the casing section 302. The running tool or temporary anchor providing the initial support for the assembly 300 may now be released.

Arrangements which allow a tubular to be supported while a mandrel is advanced through the supported tubular are described, for example, in U.S. Pat. No. 6,021,850, and US Patent Application Publication Nos. US2004/0149442 and US2005/0161226, the disclosures of which are herein incorporated by reference in their entirety.

The operation of the keys or dogs provided on the mandrel 314 (and on the mandrels of the embodiments subsequently described below) for picking-up and then releasing the cones 310, 312 will not be described here in any detail, and may be assumed to operate in a similar manner to the keys of the embodiment as described in detail above.

Figure 18:
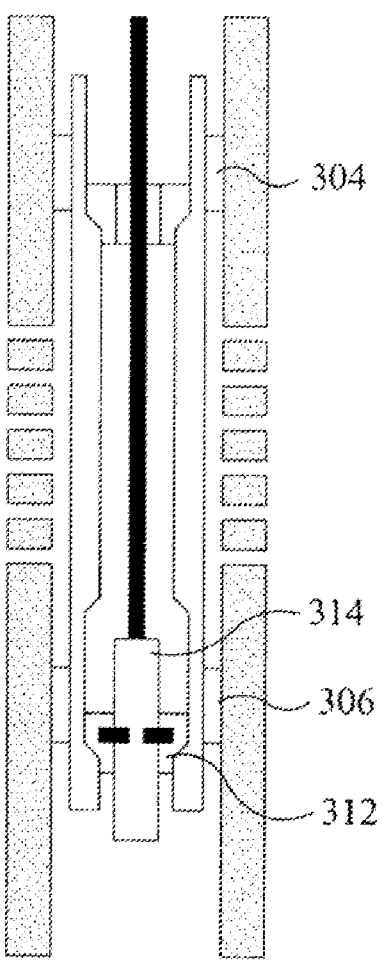
FIGS. 15, 16, 17 and 18 are schematic illustrations of a top-down straddle setting operation in accordance with another embodiment of the present invention.
Figure 17:
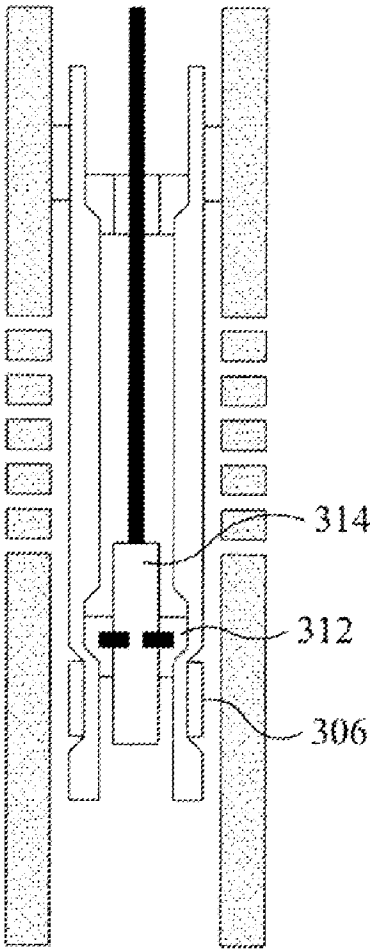
Figure 16:
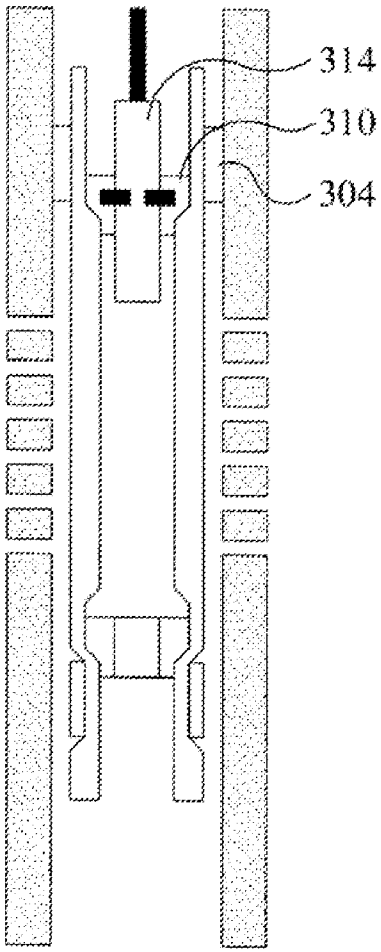
Figure 15:
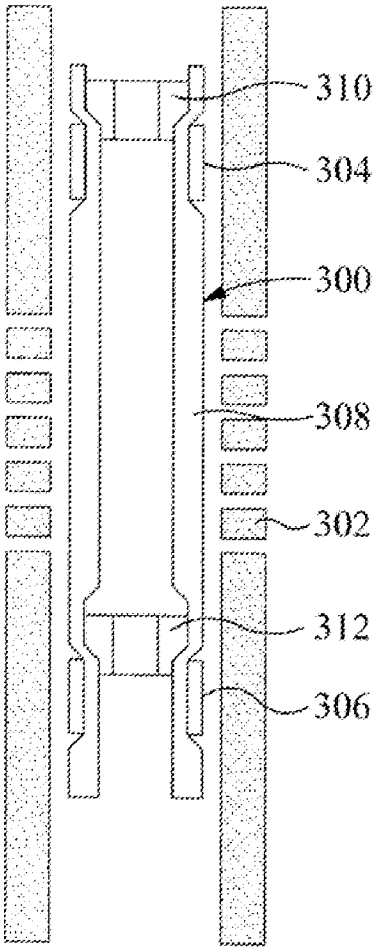

The mandrel 314 is released from the top cone 310 and may be lowered through the tubing section 308 to engage the lower cone 312, as illustrated in FIG. 17. The cone 312 may then be translated through the seal 306 to set the seal 306 and anchor the lower end of the assembly 300 to the casing 302, as illustrated in FIG. 18. The mandrel 314 may then be released from the cone 312 and retrieved. In some circumstances it may be possible to retrieve the top cone 310 with the mandrel 314.

The cones 310, 312 may be of the same or different diameter, and the seals 304, 306 may be of the same or different starting or final diameter, such that the ends of the assembly 300 may be located in casing sections of different diameter.

In other embodiments the solid walled tubing section may be, for example, a non-expandable sand screen.

Reference is now made to FIGS. 19, 20, 21 and 22 of the drawings, which are schematic illustrations of a bottom-up straddle setting operation in accordance with a still further embodiment of the present invention. The operation is similar in many respects to the operation described above, with reference to FIGS. 15 to 18, and in the interest of brevity only the primary differences between the operations will be described.

The bottom cone 412 may have been mounted to the expansion mandrel 414 during initial assembly or make up, such that the bottom cone 412 may support the assembly 400. Alternatively, the expansion mandrel 414 may pick up the cone 412 at the commencement of the straddle setting operation. In any event, the cone 412 is pulled through the lower seal 406 on the mandrel 414 and sets the seal 406 and also anchors the assembly 400 in the casing section 402.

Figure 22:
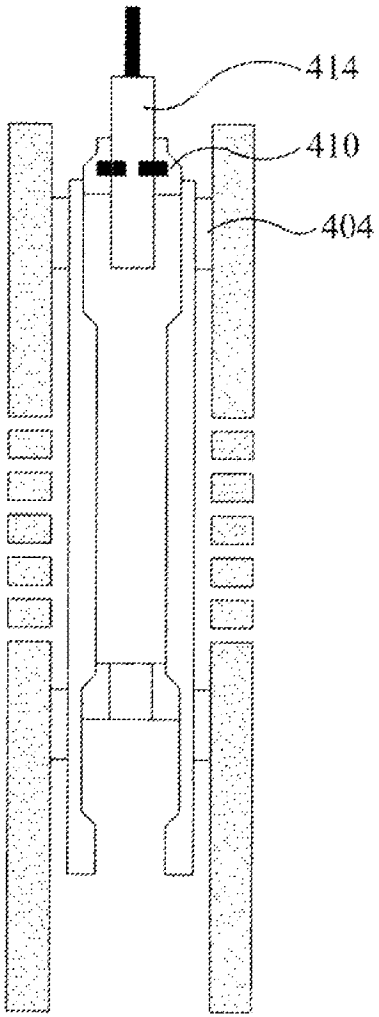
FIGS. 19, 20, 21 and 22 are schematic illustrations of a bottom-up straddle setting operation in accordance with a still further embodiment of the present invention.
Figure 21:
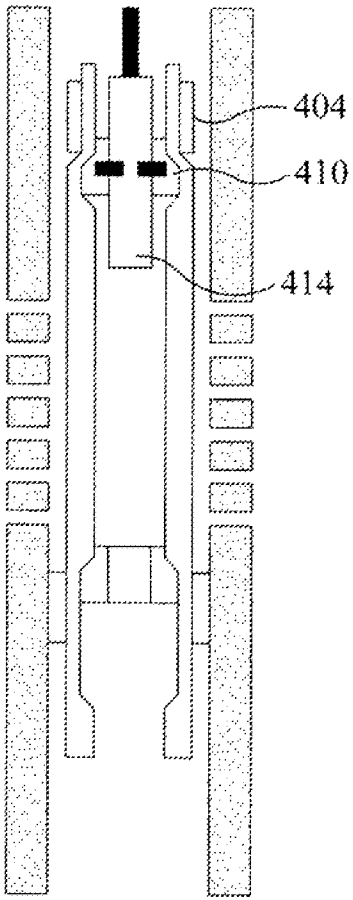
Figure 20:
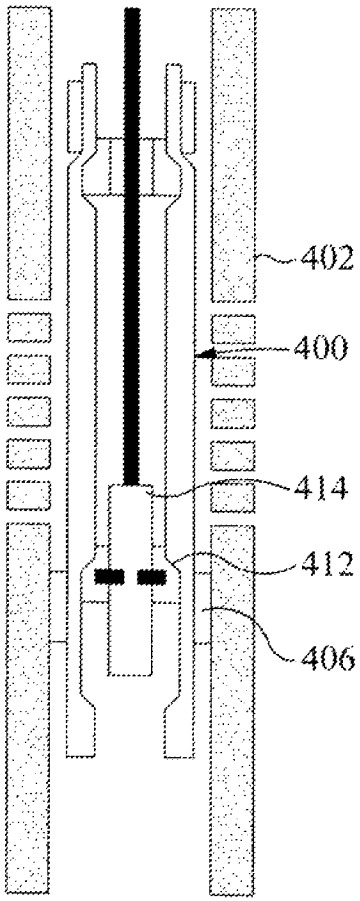
Figure 19:
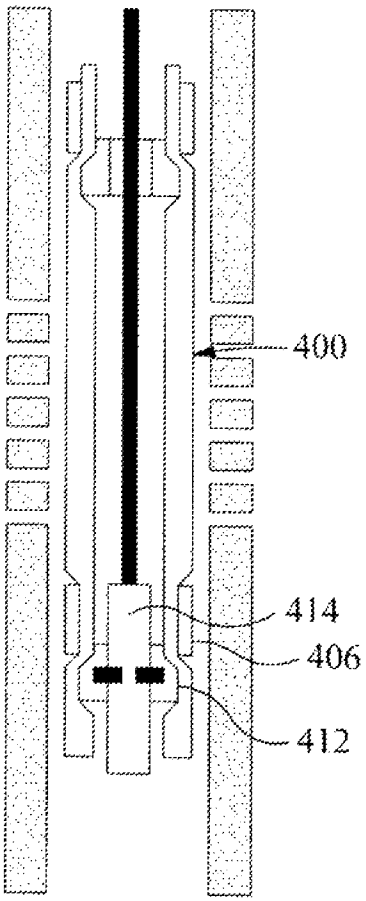

The mandrel 414 is released from the bottom cone 412 and conveyed through the tubing section 408 to engage the upper cone 410, as illustrated in FIG. 21. The cone 410 may then be translated through the seal 404 to set the seal 404, as illustrated in FIG. 22. The mandrel 414 may then be released from the cone 410 and the mandrel retrieved, or the mandrel 414 and the cone 410 may be retrieved together.

Figure 23:
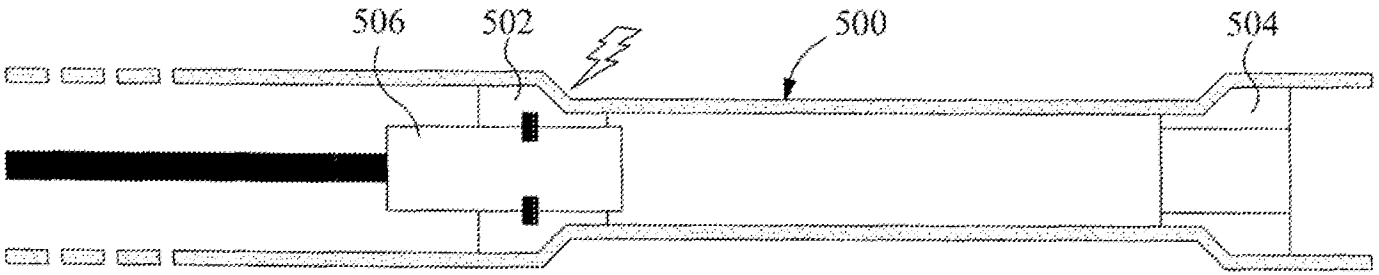
FIGS. 23, 24 and 25 are schematic illustrations of a tubular expansion operation in accordance with a yet further embodiment of the present invention.
Figure 24:
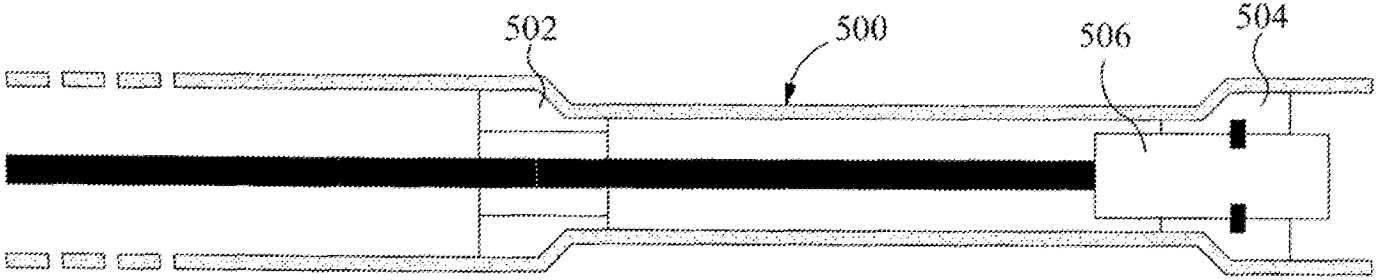
Figure 25:
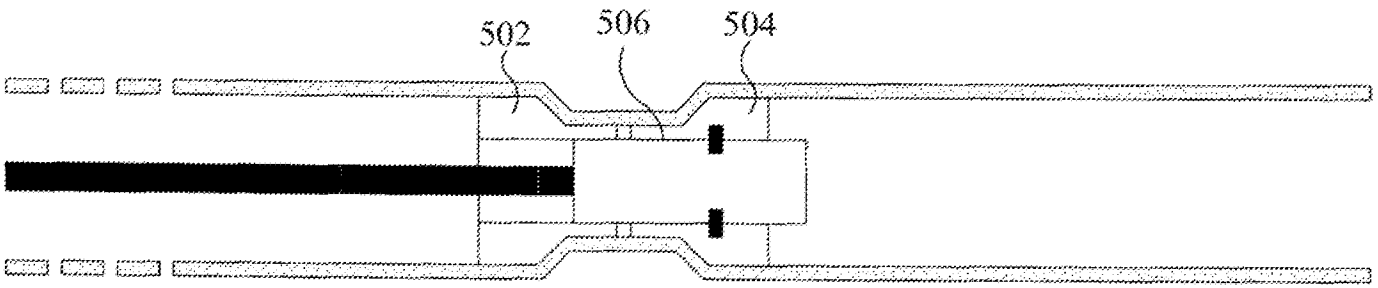

Reference is now made to FIGS. 23, 24 and 25 of the drawings, which are schematic illustrations of a tubular expansion operation in accordance with a yet further embodiment of the present invention. In this embodiment, features of the invention are utilised in an arrangement intended to minimise the effects of an expansion cone becoming stuck or jammed in a tubular, for example an expandable sand screen section 500.

Two expansion cones 502, 504 are pre-installed in the sand screen section, a first cone 502 at the upper end of the section, and a second, back-up cone 504 at the bottom of the section. The second cone 504 may be sized the same as the first cone 502. In other embodiments, the cones may differ, for example the second cone 504 may be slightly smaller, larger or of a different configuration. The cones 502, 504 are adapted to be selectively engaged and translated by a mandrel 506.

FIG. 23 illustrates the partially expanded section 500, after the first cone 502 has been picked up by the mandrel 506 and translated through the section 500, but has then become stuck. In this circumstance, the cone 502 is released from the mandrel 506, and the mandrel 506 is then run through the cone 502 and the remainder of the section 500 to latch onto the second cone 504, as illustrated in FIG. 24. The cone 504 is then pulled up through the section 500 to expand the majority of the remaining screen, until encountering the first cone 502. The mandrel 506 may then be released from the cone 504 and retrieved.

While it is recognised as being undesirable to have cones 502, 504 left within the producing area of the screen section, this is more desirable than having a significant section of the screen left unexpanded. The cones 502, 504 may define a relatively large inner diameter, and thus present little if any flow or access restriction.

In other embodiments it may be possible to pull or push one or both of the cones 502, 504 back to an initial starting position outwith the producing area of the screen.

Figure 26:
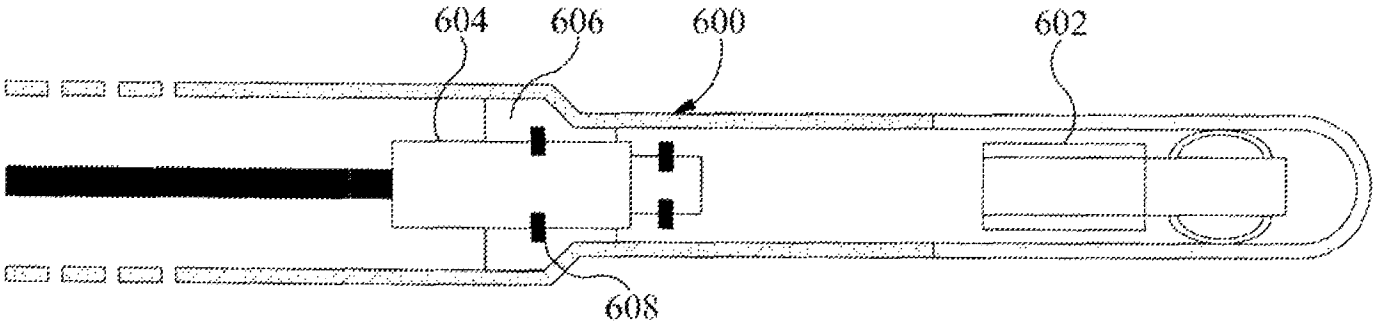
FIGS. 26, 27 and 28 are schematic illustrations of an expansion and logging operation in accordance with an embodiment of a further aspect of the present invention.
Figure 27:
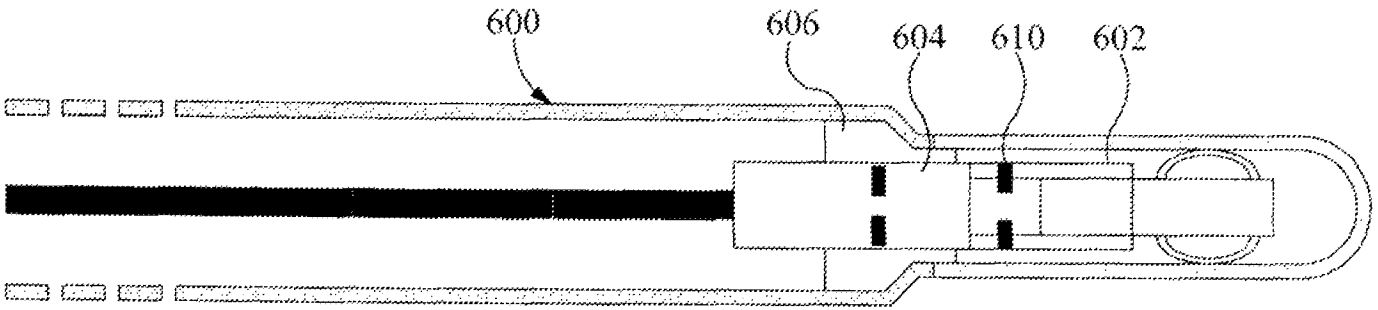
Figure 28:
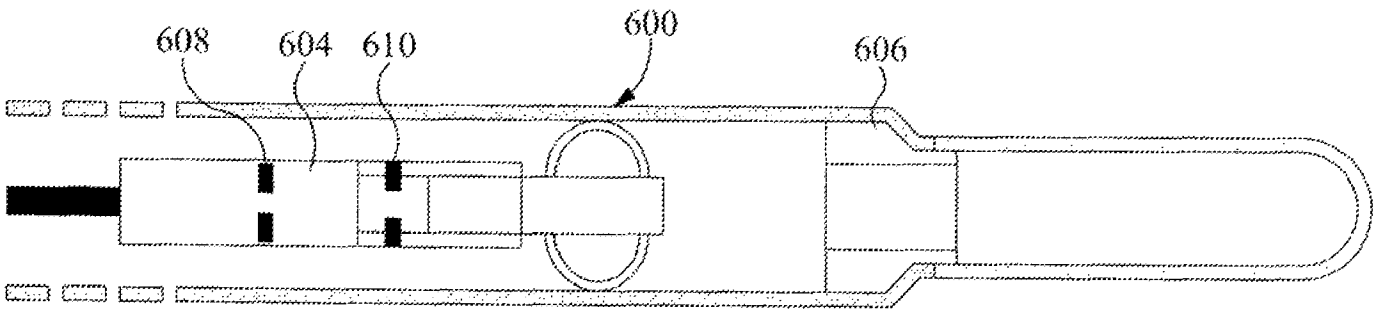

Reference is now made to FIGS. 26, 27 and 28 of the drawings, which are schematic illustrations of an expansion and logging operation in accordance with an embodiment of a further aspect of the present invention. This aspect of the invention shares a number of features with applicant's earlier US patent application filed Oct. 13, 2006, Ser. No. 11/549,546, the disclosure of which is herein incorporated by reference in its entirety.

The illustrated operation differs from the embodiments described above in that a mandrel is utilised to pick up a device other than an expansion device, in the illustrated example this being a logging tool. In other embodiments other tools or devices could be picked up.

An expandable sand screen section 600 has a pre-installed logging tool 602 at its lower end. A mandrel 604 is run into the section 600 and picks up an expansion cone 606 with a first set of dogs 608. The cone 606 is translated though the screen 600. After fully expanding the screen 600, a second set of dogs 610 on the mandrel 604 engage a corresponding profile on the tool 602, allowing the tool 602 to be translated through the expanded screen 600. The cone 606 may be released from the mandrel 604 and left in the lower end of the screen 600, or may be retrieved with the tool 602 (not shown).

The dogs 608, 610 may be configured to automatically latch and disengage the cone 606 and tool 602, or may require specific energising and release. In other embodiments only a single set of dogs may be provided, the dogs being adapted to selectively engage and pick up the cone 606 and then the tool 602.

Although the illustrated embodiments utilise expansion cones, those of skill in the art will recognise that many of the advantages offered by the invention will also apply when different forms of expansion device are utilised in place of or in combination with cones.

The invention claimed is:

1. A support for an expansion device, the support comprising:

a support mandrel; and a first engagement member adapted for selectively coupling the expansion device to the support mandrel, wherein the engagement member is movable in a radial direction between an extended position in which the engagement member engages the expansion device and a retracted position in which the engagement member disengages from the expansion device.

2. The support of claim 1, further comprising a second engagement member adapted to centralize the expansion device on the support mandrel when the expansion device is coupled to the support member.

3. The support of claim 2, wherein the second engagement member is spaced apart from the first engagement member along a longitudinal axis of the support mandrel.

4. The support of claim 1, wherein the first engagement member in the extended position is configured to engage a profile in the expansion device.

5. The support of claim 1, wherein the first engagement member is movable between the extended position and the retracted position multiple times.

6. The support of claim 1, wherein the first engagement member is configured to selectively couple multiple expansion devices to the support mandrel.

7. The support of claim 1, further comprising a support sleeve configured to move the first engagement member between the extended position and the retracted position.

8. The support of claim 7, wherein the support sleeve is movable relative to the support mandrel by application of fluid pressure.

9. The support of claim 7, wherein a support portion of the support sleeve is adjacent the first engagement member in the extended position and a recessed portion of the support sleeve is adjacent the first engagement member in the retracted position.

10. A method of expanding a portion of a downhole tubular in a single trip, the method comprising:

providing a support with a first expansion member and a second expansion member, wherein the support includes one or more engagement members adapted to selectively couple the first expansion member to the support;

expanding a first portion of the downhole tubular using the first expansion member;

releasing the first expansion member from the support; and expanding a second portion of the downhole tubular using the second expansion member.

11. The method of claim 10, further comprising pumping fluid through the support to move the one or more engagement members from an extended position to a retracted position in order to release the first expansion member from the support.

12. The method of claim 10, further comprising applying a predetermined force to the support to disengage the one or more engagement members from the first expansion member in order to release the first expansion member from the support.

13. The method of claim 10, wherein the second expansion member has a smaller outer diameter than an outer diameter of the first expansion member.

14. A method of expanding a portion of a downhole tubular in a single trip, the method comprising:

expanding a portion of the downhole tubular using an expansion member coupled to a support;

releasing the expansion member from the support;

moving the support through the downhole tubular and engaging a tool; and removing the support and the tool from the downhole tubular.

15. The method of claim 14, further comprising coupling the expansion member to the support.

16. The method of claim 15, wherein the expansion member is disposed within the downhole tubular prior to coupling to the support.

17. The method of claim 14, wherein the tool is a logging tool.

18. A method of expanding first and second portions of a downhole tubular in a single trip, the method comprising:

translating a first expansion device in a first direction through the first portion of the downhole tubular to expand the first portion of the downhole tubular to a first diameter; and then translating a second expansion device initially mounted proximate the second portion of the downhole tubular in the first direction through the second portion of tubular to expand the second portion of the downhole tubular to the first diameter.

19. A method of expanding a portion of a downhole tubular in a single trip, the method comprising:

providing an expansion device comprising a releasably mounted outer expansion member and an inner expansion member;

applying a translating force to the expansion device to drive the expansion device through a tubular to expand the tubular using the outer expansion member;

encountering a restriction;

driving the expansion device past the restriction, the outer expansion member being retained at the restriction; and expanding a further portion of the tubular utilising the inner expansion member.

20. The method of claim 19, further comprising further expanding said further portion of the tubular utilising the outer expansion member.

* * * * *